United States Patent [19]

Sugiyama

[11] Patent Number: 5,017,156

[45] Date of Patent: May 21, 1991

[54] ELECTRICAL CONNECTOR

[75] Inventor: Keishi Sugiyama, Yao, Japan

[73] Assignee: Hosiden Electronics Co., Ltd., Yao, Japan

[21] Appl. No.: 473,452

[22] Filed: Feb. 1, 1990

[30] Foreign Application Priority Data

Feb. 28, 1989 [JP] Japan ..... 1-23658[U]

[51] Int. Cl.[5] ..... H01R 13/648

[52] U.S. Cl. ..... 439/607

[58] Field of Search ..... 439/607, 610, 609, 676

[56] References Cited

U.S. PATENT DOCUMENTS

| | | | |
|---|---|---|---|
| 4,781,623 | 11/1988 | Philippson et al. | 439/676 |
| 4,854,895 | 8/1989 | Komatu | 439/610 |
| 4,908,335 | 3/1990 | Cosmos et al. | 439/609 |
| 4,913,664 | 4/1990 | Dixon et al. | 439/607 |

*Primary Examiner*—Joseph H. McGlynn
*Assistant Examiner*—Hien D. Vu
*Attorney, Agent, or Firm*—Jones, Tullar & Cooper

[57] ABSTRACT

The present invention relates to an electrical connector comprising a shielding frame having a casing portion, a U-shaped portion and a flat-plate portion which are integrally formed. The casing portion covers the contacts of contact pieces. The U-shaped portion covers the top surface and left-hand and right-hand lateral sides of the main body of a contact piece supporting member which houses the terminal portions of the contact pieces. The flat-plate portion covers the back side of the main body of the contact piece supporting member. Accordingly, the frame substantially perfectly surrounds the contact pieces, thus producing a shielding effect. Except for the bottom of the connector, the contact pieces may be generally surrounded by merely turning the flat-plate portion at the boundary thereof with respect to the U-shaped portion, after the contact piece supporting member assembled with the contact pieces has been assembled with the U-shaped portion and the casing portion.

12 Claims, 5 Drawing Sheets

ELECTRICAL CONNECTOR

BACKGROUND OF THE INVENTION

1. Field of the Invention

The present invention relates to an electrical connector which is adapted to be used in, for example, a computer and for which an anti-noise measure is being taken with the use of shielding frame means.

2. Description of the Prior Art

As a connector for which an anti-noise measure is being taken, there is known a connector of the type in which two metallic frames surround the entire circumference of a body which houses L-shaped contact pieces except for the terminal portions thereof, and in which these two frames are connected to each other with screws or the like. As an example of such a connector, there is known a connector disclosed by U.S. Pat. No. 4,337,989. In this connector, the body is housed in a frame having a U-shaped section which surrounds the top surface and the left-hand and right-hand lateral sides of the body. The body is mounted on a printed circuit board having a plate-like frame, and these two frames are connected to each other with screws.

According to the conventional connector mentioned above, the body housing the contact pieces is perfectly surrounded, at the entire circumference thereof, by the two frames, thus producing effective shielding results.

However, the conventional connector mentioned above requires two frames and screws for connecting the frames to each other. Accordingly, it would be desirable to provide a connector the manufacturing cost of which may be reduced, i.e., the number of component elements is reduced, yet assuring a shielding effect equivalent or superior to that of the conventional connector above-mentioned. Further, it is difficult to use the conventional connector mentioned above alone as a single unit. That is, this conventional connector causes inconvenience when the connector is used as always combined with a printed circuit board having a plate-like frame.

SUMMARY OF THE INVENTION

In view of the foregoing, the present invention has as an object providing an electrical connector which assures a shielding effect equivalent or superior to that of the conventional electrical connector, with the use of one frame formed by bending a one-piece metallic plate, and which can be used alone as a single unit.

It is another object of the present invention to provide an electrical connector in which the frame securely holds a contact piece supporting member incorporating contact pieces.

It is a further object of the present invention to provide an electrical connector in which the contact piece supporting member stably holds horizontal portions of the contact pieces on which contacts are formed.

To achieve the objects above-mentioned, the electrical connector in accordance with a first embodiment of the present invention comprises:

- L-shaped contact pieces having terminal portions and horizontal portions turned therefrom, the contacts being formed on the horizontal portions;
- a contact piece supporting member having a main body for housing parts of the terminal portions of the contact pieces; and
- a frame having (i) a casing portion for surrounding the entire circumference of the horizontal portions of the contact pieces projecting from the main body of the contact piece supporting member, (ii) a U-shaped portion formed at the rear end of the casing portion for surrounding the top surface and the left-hand and right-hand lateral sides of the main body, and (iii) a flat-plate portion formed at the rear end of the upper plate of the U-shaped portion and adapted to be turned at the boundary thereof with respect to the U-shaped portion, thereby covering the back side of the main body.

According to the electrical connector having the arrangement mentioned above, the horizontal portions of the contact pieces projecting from the main body of the contact piece supporting member are perfectly surrounded, at the entire circumference thereof, by the casing portion of the frame, and the top surface and the left-hand and right-hand lateral sides of the main body are surrounded by the U-shaped portion of the frame. Further, the back side of the main body is covered with the flat-plate portion of the frame. Accordingly, the one-piece frame substantially entirely surrounds the contact pieces and the contact piece supporting member. This produces effective shielding results. The underside of the contact piece supporting member is adapted to be shielded when the electrical connector is mounted on a printed circuit board. Accordingly, even though the electrical connector is used as a single unit, it is not required that the underside of the connector is shielded by the frame.

Further, the electrical connector of the present invention requires only one shielding frame. This eliminates screws for frame connection. Therefore, as compared with the conventional connector above-mentioned, the electrical connector of the present invention is reduced in the number of component elements according to the reduction in the number of frames and the elimination of screws. This results in a cost reduction. Further, since a single frame is used and the contact piece supporting member is assembled with this single frame, the electrical connector of the present invention may be used as a single unit.

According to the present invention, the electrical connector may be arranged such that:

- the contact piece supporting member is provided at one end of the main body thereof with a base portion, the base portion projecting forwardly from the one end of the main body above-mentioned;
- the casing portion of the frame is formed by bringing, face to face with each other, both lateral end surfaces of a metallic plate bent in the form of a case;
- pawls rearwardly project from both lateral ends of the metallic plate, the pawls being integrally formed with the metallic plate; and
- the pawls are fitted in an engagement hole formed in the tip end of the base portion.

According to the electrical connector having the arrangement above-mentioned, the casing portion of the frame formed by bending the metallic plate, is engaged with the base portion of the contact piece supporting body. This prevents the casing portion from being deformed in such a direction as to open the casing portion. Accordingly, the base portion reinforces the casing portion, enhancing the strength of the casing portion. Thus, although the casing portion of the frame is formed in a simple structure in which both ends of the metallic plate bent in the form of a case are brought face to face with each other, the casing portion is hardly opened or deformed even though a load is repeatedly applied to the casing portion in such a direction as to open the same when a counter connector (for example, a plug) is inserted into or removed from the casing portion.

According to the present invention, the contact piece supporting member may have a contact piece holding portion for holding the horizontal portions of the contact pieces projecting from the main body. In such an arrangement, the electrical connector may have great strength which stands the contact-pressures applied by the contacts of the contact pieces of a counter connector. In this case, the contact piece holding portion may have openings formed by longitudinal ribs and a transverse rib, and the horizontal portions of the contact pieces may be fitted in stepped portions formed on the longitudinal ribs, and small engagement pieces formed at the tips of the horizontal portions may be inserted in small holes formed in the transverse rib. In this case, even though the horizontal portions are thin, the horizontal portions are hardly deformed, thus providing a structure having great strength, as mentioned earlier.

According to the electrical connector of a second embodiment of the present invention, the contact piece supporting member in the first embodiment of the present invention, is provided in the lateral sides of the lower end of the main body thereof with engagement grooves, into which are fitted engagement pieces formed at downwardly turned sides of the U-shaped portion of the frame. According to such an arrangement, the contact piece supporting member may be readily assembled with the frame.

According to the present invention, the flat-plate portion of the frame may be provided at both sides thereof with engagement pieces, the engagement pieces having engagement holes, and the U-shaped portion may be provided on leg portions thereof with cut-raised engagement pieces with which the engagement holes are engaged. According to such an arrangement, the flat-plate portion may be held as turned without the engagement pieces or the engagement holes damaged.

According to the present invention, the base portion of the contact piece supporting member may be provided at both sides of an engagement hole thereof with forwardly projecting projections, on which the rear end sides of both lateral ends of the casing portion of the frame overlap. Such an arrangement effectively prevents the casing portion from being deformed at the time of insertion or removal of a counter contact.

DETAILED DESCRIPTION OF THE PREFERRED EMBODIMENTS

Figure 1:
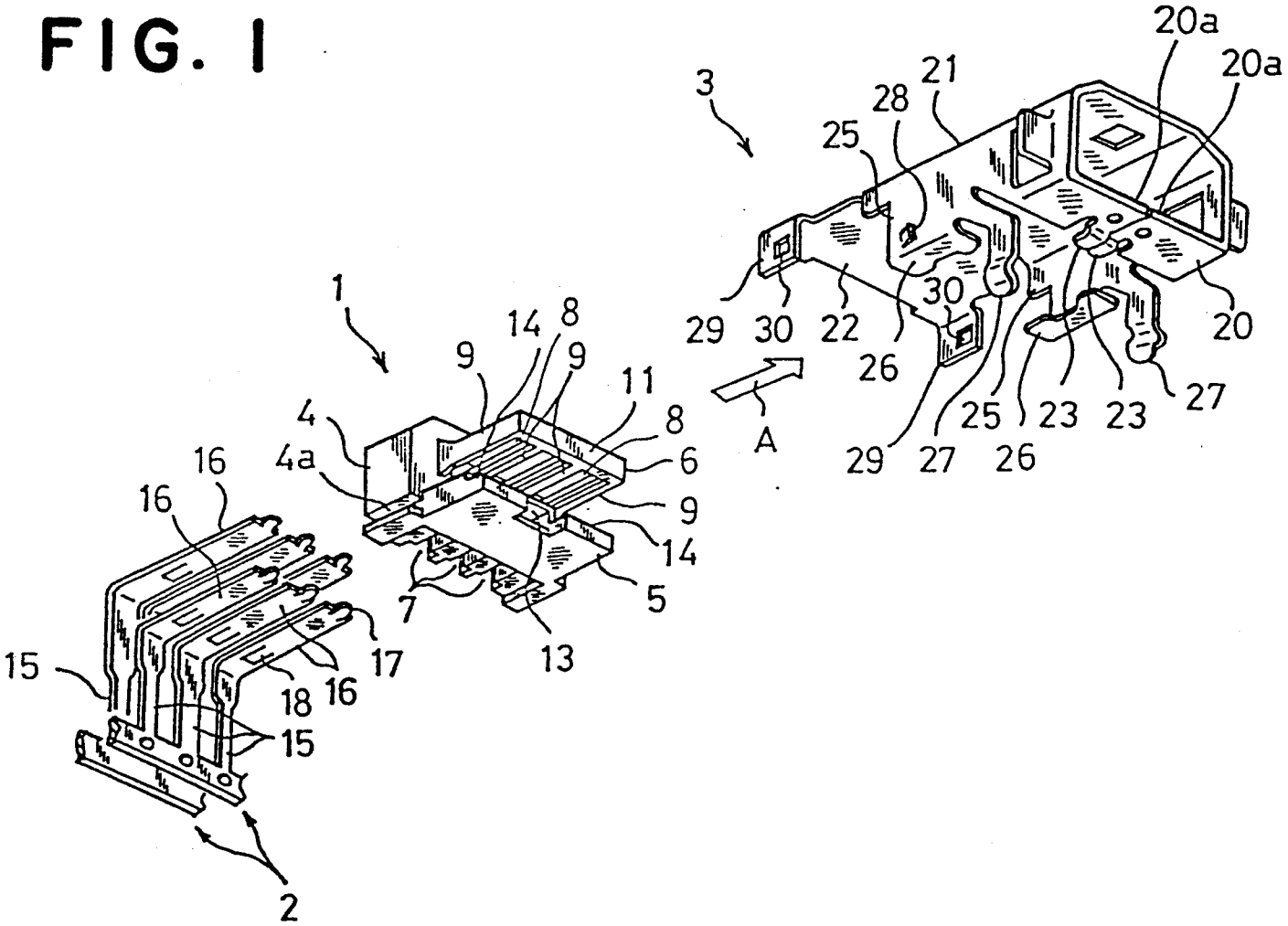
FIG. 1 is an exploded perspective view of an electrical connector in accordance with the present invention.

As shown in FIG. 1, the electrical connector in accordance with the present invention comprises a contact piece supporting member 1, contact pieces 2 and a shielding frame 3.

Figure 4:
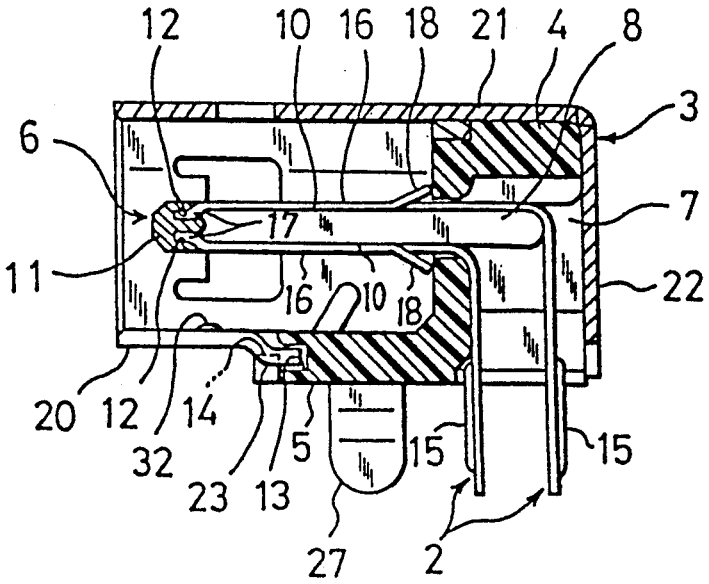
FIG. 4 is a section view taken along the line IV—IV in FIG. 3.
Figure 5:
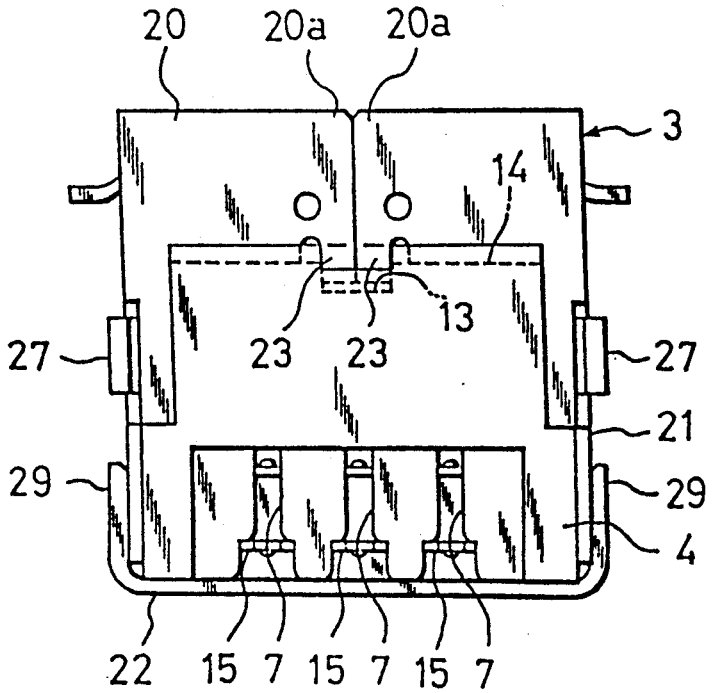
FIG. 5 is a bottom view of the electrical connector in FIG. 1.

The contact piece supporting member 1 is a synthetic-resin molded body integrally provided with a main body 4, a base portion 5 projecting from one end of the underside of the main body 4 at a right angle to the lateral sides of the main body 4, and a contact piece holding portion 6 projecting substantially from the center in the height direction of the main body 4 in a direction parallel to the base portion 5. The main body 4 is provided on both sides of the lower end thereof with engagement grooves 4*a*. As shown in FIGS. 1, 4, 5, 6 and 7, the main body 4 has a plurality of grooves 7 which are opened in the back side and underside of the main body 4. These grooves 7 communicate with a plurality of slit-like openings 8 formed in the contact piece holding portion 6. In the contact piece holding portion 6, longitudinal ribs 9 at the left-hand and right-hand ends thereof and adjacent to the openings 8 have stepped portions 10 extending to the grooves 7, as shown in FIG. 4. The contact piece holding portion 6 has a front-end transverse rib 11 having small holes 12 communicating with the stepped portions 10, as also shown in FIG. 4. The base portion 5 is provided at the tip center thereof with an engagement hole 13. Projections 14 project, at both sides of this engagement hole 13, in the same projecting direction of the contact piece holding portion 6.

Figure 7:
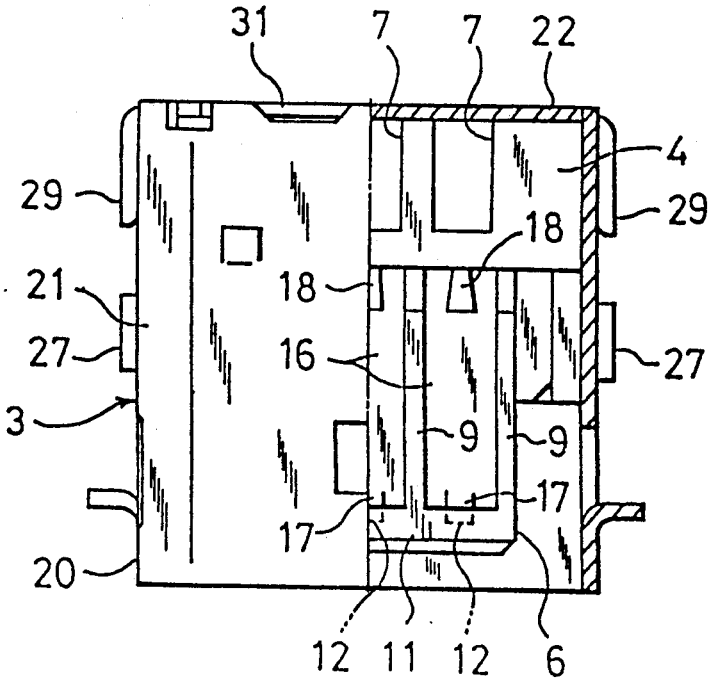
FIG. 7 is a section view taken along the line VII—VII in FIG. 3.

Each of the contact pieces 2 is made of an L-shaped metallic piece having terminal portions 15 and horizontal portions 16 having a contact. The horizontal portions 16 are provided at the tips thereof with small cut-raised engagement pieces 17, and at the intermediate portions thereof with cut-raised pieces 18. The horizontal portions 16 are inserted into the main body 4 from the side of the grooves 7, and pass through the main body 4. This causes the horizontal portions 16 to be positioned as shown in FIGS. 4 and 7 in which the tip-side small engagement pieces 17 are inserted in the small holes 12 in the contact piece holding portion 6. The horizontal portions 16 are supported, at the entire lengths thereof, by the stepped portions 10. By such an arrangement, the horizontal portions 16 which are even very thin, are hardly deformed. Accordingly, the horizontal portions 16 are adapted to sufficiently stand the contact-pressures generated when the contact pieces 2 come in contact with the contacts of contact pieces of a counter connector (plug), to be discussed later. The terminal portions 15 of the contact pieces 2 are perfectly housed in the grooves 7 in the main body 4 with only the lower ends of the terminal portions 15 projecting from the underside of the main body 4. Such projecting portions are adapted to be inserted into holes in a printed circuit board (not shown) and soldered thereat. As clearly shown in FIG. 4, the contact pieces 2 are held in an opposite manner on and under the contact piece holding portion 6.

The shielding frame 3 comprises a casing portion 20, a U-shaped portion 21 extending from the rear end of the casing portion 20 and a flat-plate portion 22 extending from the U-shaped portion 21, these members 20, 21, 22 being integrally formed. These members 20, 21, 22 may be made by bending a one-piece metallic plate having a relatively great rigidity.

The casing portion 20 is formed by bringing, both lateral end surfaces of the metallic plate bent in the form of a case face to face with each other. There are formed pawls 23 rearwardly projecting from both lateral end portions 20*a* including these lateral end surfaces. The U-shaped portion 21 having a U-shaped section has leg portions 25 each of which has an engagement piece 26, a terminal portion 27 and an engagement piece 28.

The engagement pieces 26 are formed by inwardly bending the rear portions of the lower portions of the leg portions 25. The terminal portions 27 project downwardly from the front portions of the lower portions of the leg portions 25. The engagement pieces 28 are formed by cutting an<raising parts of the lateral sides of the leg portions 25. The flat-plate portion 22 extends from the rear end of the upper plate of the U-shaped portion 21. The flat-plate portion 22 is provided at both sides of the end thereof with engagement pieces 29 which are downwardly turned. The engagement pieces 29 have engagement holes 30.

Figure 2:
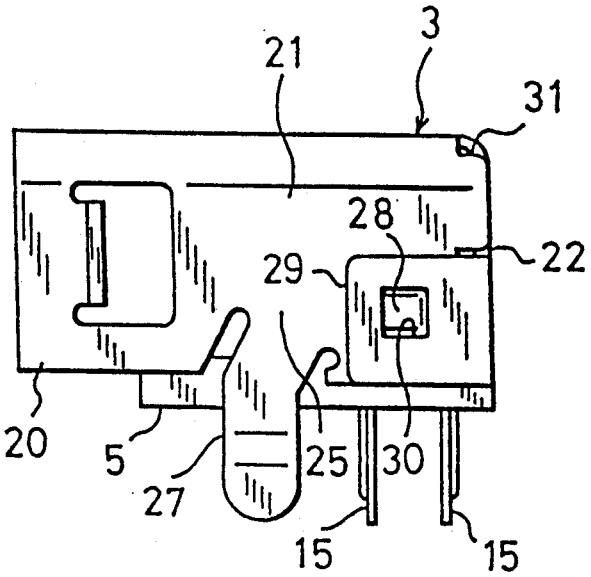
FIG. 2 is a side view of the electrical connector in FIG. 1.
Figure 3:
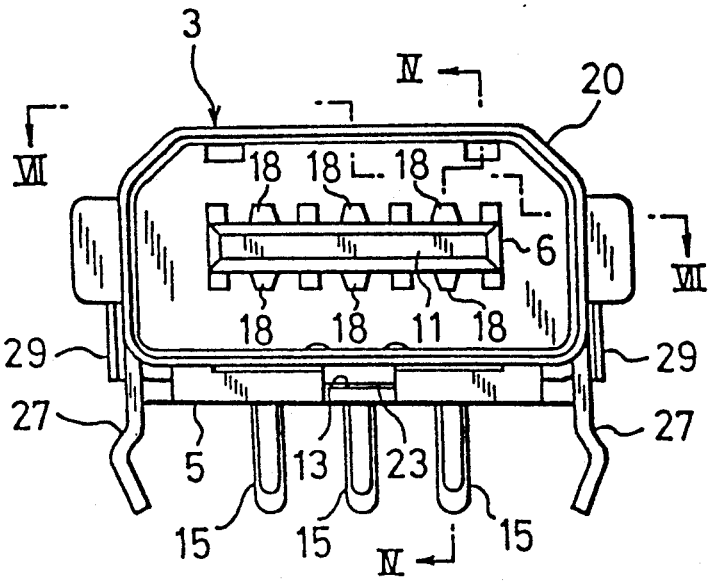
FIG. 3 is a front view of the electrical connector in FIG. 1.
Figure 6:
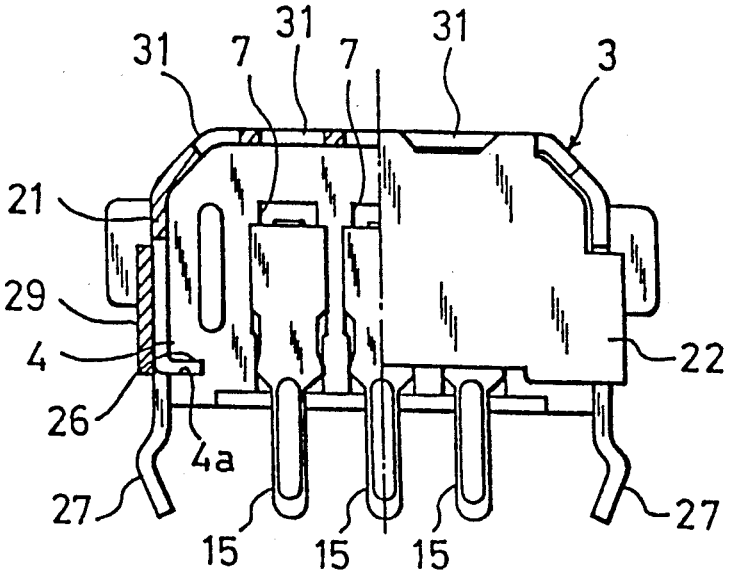
FIG. 6 is a back view of the electrical connector in FIG. 1 with a portion of a frame cut away.

The contact piece supporting member 1 incorporating a predetermined number of the contact pieces 2 in the manner above-mentioned, is assembled with the frame 3. As shown in FIG. 1, before the contact piece supporting member 1 is assembled with the frame 3, the flat-plate portion 22 projects rearwardly from the U-shaped portion 21. By inserting the contact piece supporting member 1 into the frame 3 in a direction shown by an arrow A in FIG. 1, the pawls 23 of the casing portion 20 are inserted into the engagement hole 13 in the base portion 5. The rear ends of the lateral end portions 20*a* of the casing portion 20 overlap on the projections 14. The engagement pieces 26 of the U-shaped portion 21 are fitted in the engagement grooves 4*a* in the main body 4. Thereafter, the flat-plate portion 22 is turned at the boundary thereof with respect to the U-shaped portion 21, thereby to cover the back side of the main body 4 as shown in FIGS. 2, 4 and 7. When the flat-plate portion 22 is turned in this manner, the engagement pieces 28 of the U-shaped portion 21 are engaged with the engagement holes 30 in the engagement pieces 29. This prevents the engagement pieces 29 from being returned due to spring back, enabling the back side of the main body 4 to be securely covered. To prevent the engagement pieces 29 from being returned after turned, the engagement holes 30 may be engaged with projections formed on the main body 4. In such an arrangement, these projections are apt to be readily shaved by the engagement pieces 29. Accordingly, the embodiment shown in FIG. 1 free from such a defect is superior. As shown in FIGS. 1, 6 and 7, the boundary portion between the U-shaped portion 21 and the flat-plate portion 22 has slots 31, with the use of which the flat-plate portion 22 may be readily turned.

In the connector assembled in the manner mentioned above, the casing portion 20 of the frame 3 surrounds the horizontal portions 16, and the U-shaped portion 21 of the frame 3 surrounds the top surface and both lateral sides of the main body 4, and the flat-plate portion 22 covers the back side of the main body 4. Accordingly, the frame 3 produces very effective shielding results for the contact piece supporting member 1 and the contact pieces 2. It is only the underside of the base portion 5 of the contact piece supporting member 1 that is not surrounded by the frame 3. This underside is adapted to be shielded when the connector is mounted on a printed circuit board.

Figure 8:
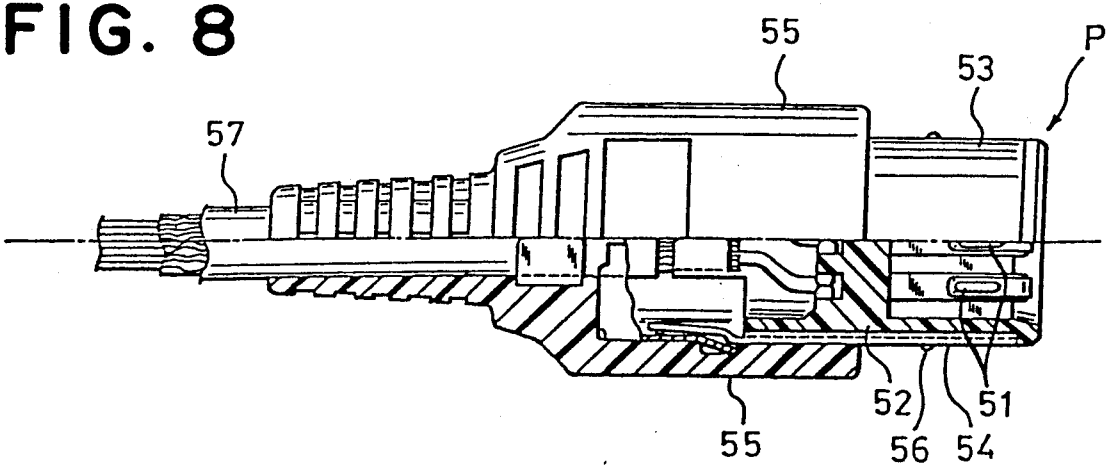
FIG. 8 is a plan view, with portions broken away, of a plug P.

FIG. 8 shows a plug P which is a counter connector adapted to be connected to the connector C mentioned above. The plug P includes contact pieces 51 contained in a housing 52, a pair of upper and lower shielding frames 53, 54 perfectly surrounding the housing 52, and a cap 55 for covering the rear end portions of the frames 53, 54. One frame 54 is provided on the lateral sides thereof with projections 56. A code 57 incorporating electric wires connected to the contact pieces 51 is extended from the rear end of the cap 55.

Figure 9:
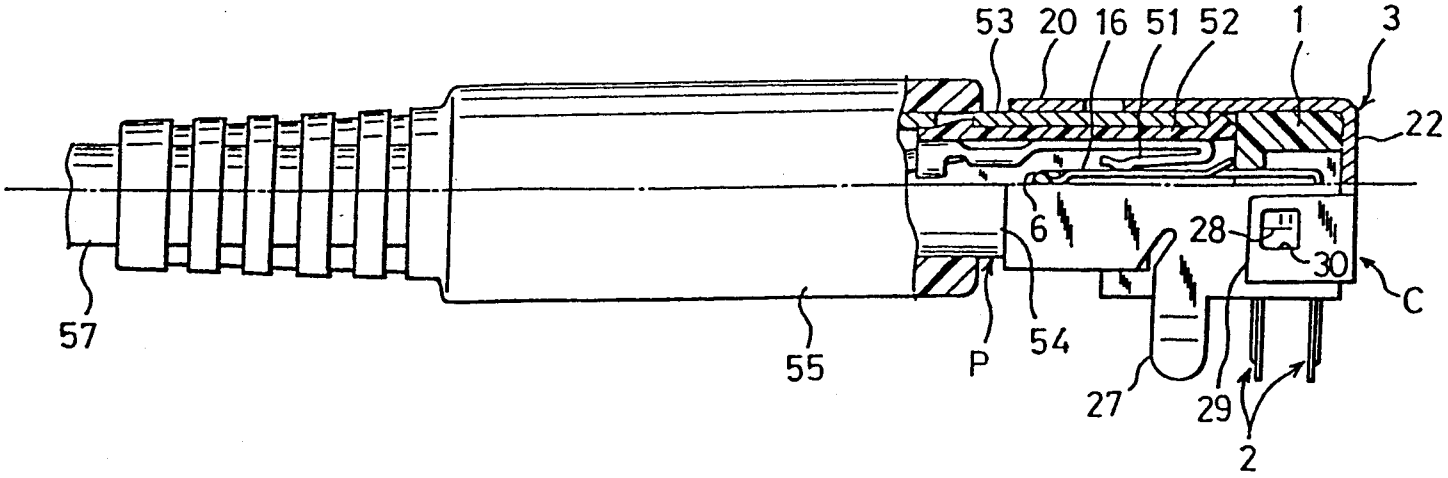
FIG. 9 is a side view, with portions broken away, of the plug in FIG. 8 connected to the electrical connector of the present invention.

FIG. 9 shows the plug P as connected to the connector C. When the plug P is inserted into the casing portion 20 of the frame 3 of the connector C as shown in FIG. 9, the frames 53, 54 of the plug P come in contact, at the substantially entire circumference thereof, with the casing portion 20 of the frame 3 of the connector C. At the same time, the projections 56 are locally strongly contact-pressed with the inner surface of the casing portion 20. Accordingly, the frame 3 and the frames 53, 54 perfectly surround the portions of the plug P connected to the connector C, thus producing effective shielding results. In the casing portion 20, the pawls 23 are engaged with the engagement hole 13 of the base portion 5 of the contact piece supporting member 1, and the rear edges of the lateral end portions 20*a* overlap on the projections 14 of the base portion 5, thereby to reinforce the casing portion 20. Accordingly, even though force for deforming the casing portion 20 in the direction to open the same is repeatedly applied thereto, the casing portion 20 is hardly deformed.

When a projection 32 is formed on the inner surface of the casing portion 20 as shown in FIG. 4, this projection 32 locally strongly strikes on the frame 54 of the plug P, producing a further secure shielding effect.

What is claimed is:

1. An electrical connector comprising:

L-shaped contact pieces having terminal portions and horizontal portions turned therefrom, with contact being formed on said horizontal portions;

a contact piece supporting member having a main body which houses parts of said terminal portions of said contact pieces; and a frame having: (i) casing portion for surrounding the entire circumference of said horizontal portions of said contact pieces projecting from said main body of said contact piece supporting member; (ii) a U-shaped portion formed at the rear end of said casing portion for surrounding the top surface and the left-hand and right-hand lateral sides of said main body; and (iii) a flat-plate portion formed at the rear end of the upper plate of said U-shaped portion and adapted to be turned at the boundary thereof with respect to said U-shaped portion, thereby covering the back side of said main body.

2. An electrical connector as set forth in claim 1, wherein the contact piece supporting member has a contact piece holding portion for holding said horizontal portions.

3. An electrical connector as set forth in claim 1, wherein the contact piece supporting member is provided in the lateral sides of the lower end of the main body thereof with engagement grooves, into which engagement pieces formed at downwardly turned sides of the U-shape portion of the frame are fitted.

4. An electrical connector as set forth in claim 1, wherein the flat-plate portion of the frame is provided at both lateral sides thereof with engagement pieces, said engagement pieces having engagement holes, and the U-shaped portion is provided on leg portions thereof with cut-raised engagement pieces with which said engagement holes are engaged.

5. An electrical connector as set forth in claim 1, wherein the contact piece supporting member is provided at one end of the main body thereof with a base portion projecting forwardly from said one end and having a tip end with an engagement hole formed therein, wherein said base portion is provided at both sides of said engagement hole thereof with forwardly projecting projections, and wherein the rear end portions of both lateral ends of the casing portion of the frame overlap said forwardly projecting projections.

6. An electrical connector as set forth in claim 1, wherein:

the contact piece supporting member is provided at one end of the main body thereof with a base portion, said base portion projecting forwardly from said one end and having a tip end with an engagement hole formed therein;

the casing portion of said frame being formed by bringing both lateral end surfaces of a metallic plate bent in the form of a case face to face with each other; and pawls projecting rearwardly from both lateral ends of said metallic plate, said pawls being integrally formed with said metallic and fitted in the engagement hole of said base portion.

7. An electrical connector as set forth in claim 6, wherein the contact piece supporting member has a contact piece holding portion for holding said horizontal portions.

8. An electrical connector as set forth in claim 7, wherein said contact piece holding portion has openings formed by longitudinal ribs and a transverse rib, the horizontal portions of the contact pieces being fitted in stepped portions formed on said longitudinal ribs, with small engagement pieces formed at the tips of said horizontal portions being inserted in small holes formed in said transverse rib.

9. An electrical connector as set forth in claim 7, wherein the contact piece supporting member is provided in the lateral sides of the lower end of the main body thereof with engagement grooves, into which engagement pieces formed at downwardly turned sides of the U-shape portion of the frame are fitted.

10. An electrical connector as set forth in claim 9, wherein the flat-plate portion of the frame is provided at both lateral sides thereof with engagement pieces, said engagement pieces having engagement holes, and the U-shaped portion is provided on leg portions thereof with cut-raised engagement pieces with which said engagement holes are engaged.

11. An electrical connector as set forth in claim 10, wherein said base portion is provided at both sides of said engagement hole thereof with forwardly projecting projections, and wherein the rear end portions of both lateral ends of the casing portion of the frame overlap said forwardly projecting projections.

12. An electrical connector as set forth in claim 11, wherein said contact piece holding portion has openings formed by longitudinal ribs and a transverse rib, the horizontal portions of the contact pieces being fitted in stepped portions formed on said longitudinal ribs, with small engagement pieces formed at the tips of said horizontal portions being inserted in small holes formed in said transverse rib.

* * * * *